US005263282A

United States Patent [19]

Cooper et al.

[11] Patent Number: 5,263,282

[45] Date of Patent: Nov. 23, 1993

[54] CABLE SYSTEM TO INSURE DOOR GLASS ROTATIONAL STABILITY

[75] Inventors: Norman F. Cooper, Mt. Clemens; Douglas E. Kuffert, Utica, both of Mich.

[73] Assignee: General Motors Corporation, Detroit, Mich.

[21] Appl. No.: 975,322

[22] Filed: Nov. 16, 1992

[51] Int. Cl.[5] ..... E05F 11/38

[52] U.S. Cl. ..... 49/348; 49/349; 49/350; 49/363

[58] Field of Search ..... 49/348-353, 49/360, 363, 362, 227

[56] References Cited

U.S. PATENT DOCUMENTS

| | | | |
|---|---|---|---|
| 4,001,971 | 1/1977 | Gobush et al. | 49/352 |
| 4,110,935 | 9/1978 | Sessa | 49/352 |
| 4,694,610 | 9/1987 | Hornivius | 49/351 |
| 4,905,412 | 3/1990 | Srock et al. | 49/352 |
| 4,908,988 | 3/1990 | Yamamura et al. | 49/358 |
| 4,910,917 | 3/1990 | Brauer | 49/348 |
| 4,920,697 | 5/1990 | Vail et al. | 49/348 |
| 4,934,099 | 6/1990 | Maekawa et al. | 49/352 |
| 4,970,827 | 11/1990 | Djordjevic | 49/349 |
| 5,035,083 | 7/1991 | Kruzich | 49/352 |
| 5,067,281 | 11/1991 | Dupuy | 49/502 |

FOREIGN PATENT DOCUMENTS 2230558 10/1990 United Kingdom .

*Primary Examiner*—Philip C. Kannan

*Attorney, Agent, or Firm*—Charles E. Leahy

[57] ABSTRACT

The window glass for a vehicle door is mounted at its lower edge in an elongated sash. The glass is raised and lowered by a regulator attached to the sash. A pair of guides (pulleys or slides) are fixed to each end of the sash and a cable, anchored to the door at points at the top and bottom of sash movement, extends parallel to the direction of window movement from the anchors to the sash and around the guides such that any up or down movement of either end of the sash is transferred to the other end so that both ends move together, thereby preventing tilting of the glass.

9 Claims, 2 Drawing Sheets

CABLE SYSTEM TO INSURE DOOR GLASS ROTATIONAL STABILITY

FIELD OF THE INVENTION

This invention relates to vehicle door windows and particularly to a mechanism for preventing rotation of a door glass.

BACKGROUND OF THE INVENTION

It is known to use cables in vehicle window regulators for raising and lowering a glass by driving the cable with a manual or a power regulator. In such cases, the cable may control the attitude of the glass as well as the vertical position. It is desired in such systems to prevent rotation of the window by guide channels or by the cables themselves so that the fore and aft portions of the window move in synchronism.

One technique for using the cable drive to move the glass in a manner to prevent rotation is a figure-8 cable configuration. The U.S. Pat. No. 4,110,935 to Sessa, entitled "Cable-Actuated, Car-Side-Window-Lifting Mechanism" illustrates this type of drive. Pairs of horizontally spaced upper and lower pulleys fixed on the door support a cable which has a vertical run at each side and crosses in the middle. Supports on the lower edge of the glass are secured to the vertical runs of the cable to control the glass position to prevent rotation by maintaining the supports at the same vertical level and by moving the supports in synchronism to raise or lower the glass. One disadvantage to that style of cable configuration is that the travel of the window glass is limited to the space between the upper and lower pulleys and the vertical thickness of the supports. That is, the total vertical available space is reduced by two pulley diameters and the support thickness.

In many vehicle models, confined space in the door well limits the window movement and it is desirable to provide a mechanism which would optimize the window travel and still provide rotational stability.

SUMMARY OF THE INVENTION

It is therefore an object of the invention to guide a vehicle window glass by a cable in a way that maximizes travel and stabilizes the glass against rotation. Another object is to mount the cable in a way that permits rotational adjustment of the glass upon assembly.

The invention is carried out by upper and lower pairs of fixed anchors on the door, a pair of guides attached to the lower edge of the glass at each end, and a cable attached to the upper anchors and routed through the guides and the lower anchors such that any moment tending to move one end of the glass will be transmitted to the other end, causing synchronous movement. A fixed attachment point at a lower anchor or between the anchors holds the cable against sliding around the lower anchors, but such sliding is permitted for adjustment purposes prior to securing the fixed attachment. The cable is used only for stabilization; window raising and lowering force is supplied by a separate regulator.

The guides may be pulleys or slides. Generally, the tension in the cable is so low that slides are adequate: the slides do not introduce appreciable friction due to the cable passing over them. The cable is routed from an upper anchor, down and around the lower surface of a guide beneath the anchor at one end of the glass, then across and over the upper surface of a guide at the other end of the glass, and then down to a lower anchor. The cable routing continues across to the other lower anchor and symmetrically over and under the other guides to the other upper anchor. When a force is applied down on one end of the glass, it produces tension in the cable passing under a guide at that end, and the tension is transmitted to the top of the guide at the other end to produce a similar downward force on the other end, keeping the forces balanced to avoid any tendency to rotate the glass.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

Figure 1:
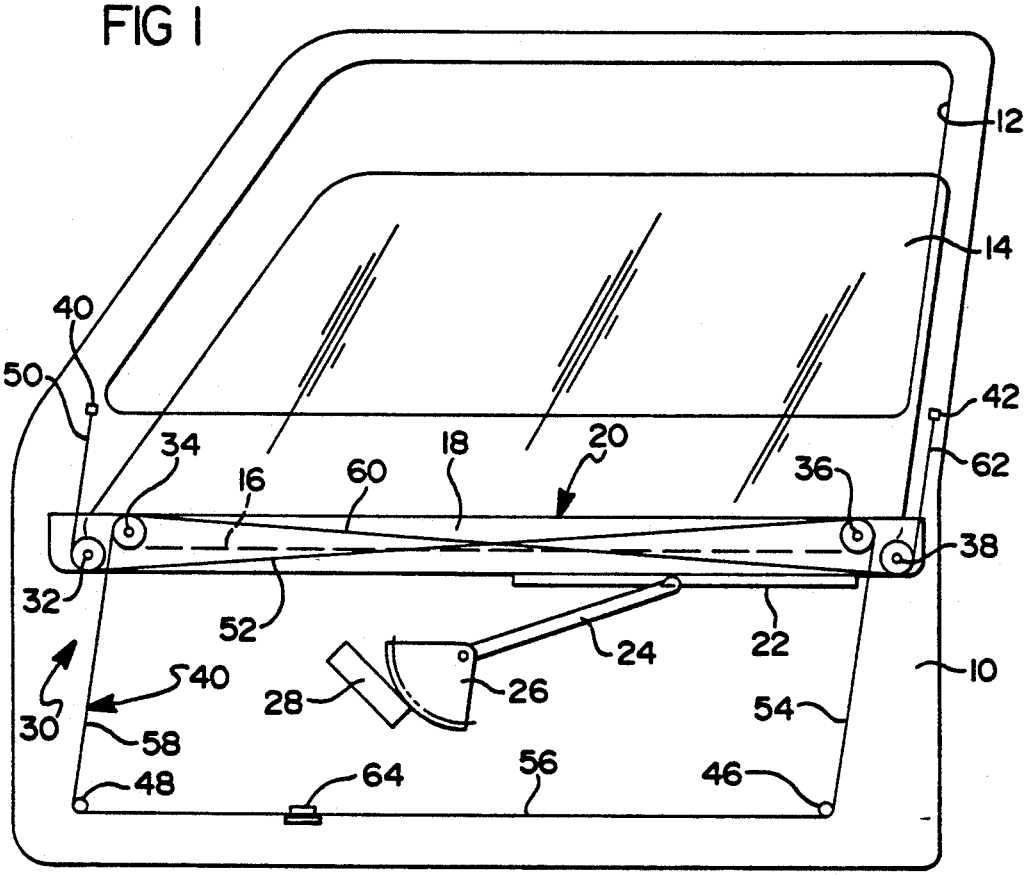
FIG. 1 is a schematic side view of a vehicle door showing window glass mounting and a stabilizing cable arrangement to prevent tilting of the glass, according to the invention.

Referring to FIG. 1, an automobile door 10 has a window opening 12 and a slidable glass 14 movable from a raised or closed position covering the opening 12 to a lowered or open position which preferably completely uncovers the opening, although in some applications the lower limit of the glass movement does not clear the window opening. The lower edge 16 of the glass is supported in a channel 18 of an elongated sash 20. A track 22 along a portion of the sash receives the end of an operator arm 24 of a window regulator 26 which may be driven by a motor 28 or manually driven. In the illustrated embodiment the window glass 14 does not move in a vertical direction but to accommodate the shape of the window opening it moves at a small angle to vertical.

A cable stabilizing system 30 attached to the door and to the sash 20 allows movement of the glass between the raised and lower positions and restrains the glass against any tilting or rotational movement. A pair of guides in the form of pulleys are secured to each end of the sash 20. At one end a lower pulley 32 and an upper pulley 34 are rotatably attached to the sash, and upper and lower pulleys 36 and 38 are mounted at the other end. A cable 40 is secured at its ends to anchors 42 and 44 on the door at locations near the bottom of the window opening. The cable is routed over a path through the pulleys and around anchors 46 and 48 at the lower portion of the door below the lowest boundary of glass movement. The cable route, beginning at the anchor 40 comprises a downward run 50 to the pulley 32, passes under the pulley 32 to a transverse run 52 to the pulley 36, passes over the pulley 36 to a downward run 54 to a lower anchor 46, then a transverse run 56 to the anchor 48, an upward run 58 to the pulley 34, passes over the pulley 34 to a transverse run 60, then under the pulley 38 and to an upward run 62 to the anchor 42. The anchors and pulley are positioned so that the upward and downward runs of the cable are mutually parallel and parallel to the direction of window movement. A clamp 64 between the anchors 46 and 48 holds the cable so that the cable does not move relative to the anchors 46 and 48 during operation of the window glass. The clamp may be loosened, however, for adjustment of the attitude of the sash. When the clamp is loose, the cable 40 can slip over the anchors 46 and 48 allowing one end of the sash to be raised or lowered relative to the other to achieve the proper tilt of the glass in the door. After adjustment the clamp 64 is tightened and the attitude of the sash and the glass is fixed. Instead of using a single cable 40 with the run 56 between the anchors 46 and 48, separate cables may be used, one extending from the anchor 40 the anchor 46 and the other extending from anchor 42 to the anchor 48. The window glass will operate in the same way as with a single cable, but the adjustment will be more difficult.

In operation, as the regulator 26 moves the window up or down, the pulleys ride on the cable such that the ends of the sash move in synchronism. Any incipient downward movement of the left end of the sash 20, for example, causes the pulley 32 to push down on the cable to increase the stress in the cable portion between anchors 40 and 46. That stress pulls down on the pulley 36 to move the right end of the sash by an amount equal to the left end. Thus any movement or either end is translated by the cable to the other end to assure synchronous movement. The cable is sufficiently taut that there is no play in the sash ends.

Figure 3:
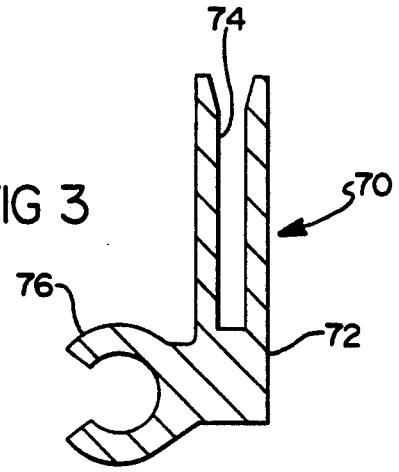
FIG. 3 is a sectional view taken along line 3—3 of FIG. 2.
Figure 2:
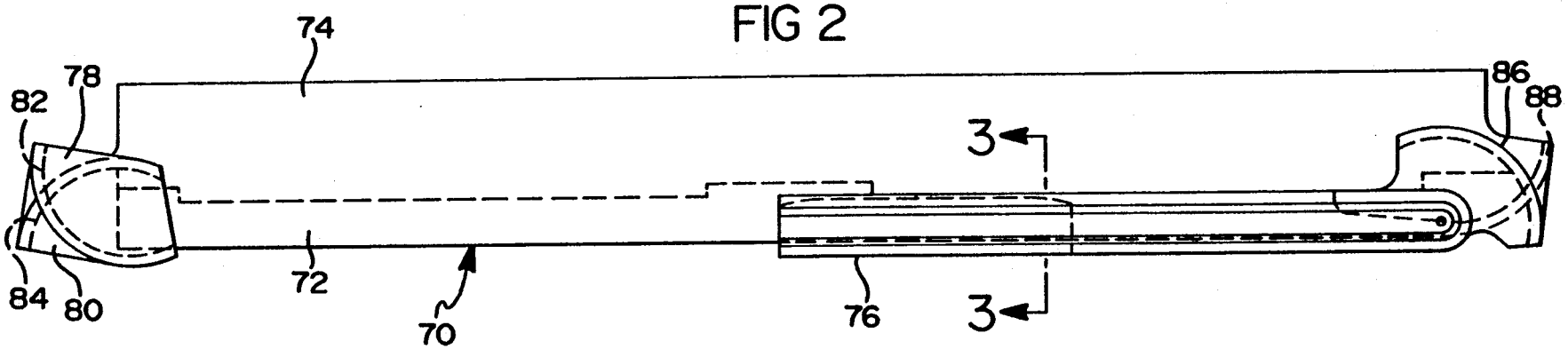
FIG. 2 is a side view of a second embodiment of a sash portion of a stabilizing arrangement to prevent tilting of the glass, according to the invention.
Figure 4:
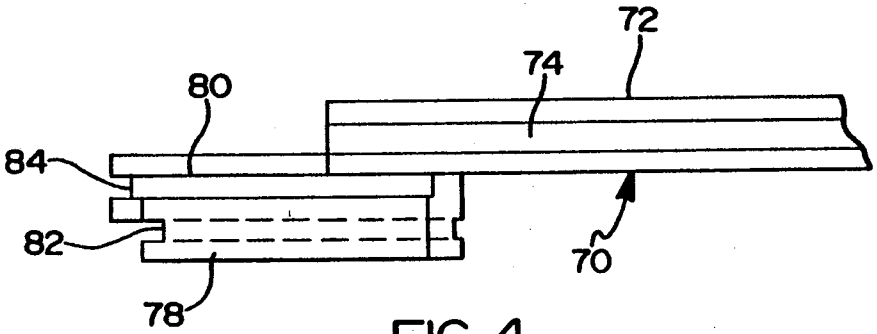
FIG. 4 is a top view of one end of the sash of FIG. 2.

Another embodiment of the sash uses arcuate slides instead of pulleys to guide the cable. Normally the tension in the cable is low so that friction between the cable and the slides is negligible. The slides lend themselves to a one-piece sash design having no moving parts, can be made of a rigid polymer material by molding, and is inexpensive. The routing of the cable and the window operation is the same as that described above. As shown in FIGS. 2, 3 and 4, the sash 70 has an elongated body 72 including a channel 74 for receiving the glass. A C-shaped track 76 along one half of the sash accommodates the window regulator attachment. First and second slides 78 and 80 are formed together at one end of the sash to provide grooved cable paths in separate planes. Each slide has an arcuate surface 82 or 84 for sliding contact with the cable and thus functions like the corresponding pulleys of the FIG. 1 embodiment. Similarly, the other end of the sash has third and fourth slides 86 and 88. The sash 70 then will function the same as the sash 20 of FIG. 1.

The cable system according to the invention optimizes the range of glass movement. The travel distance is limited only by the distance between the upper and lower anchors less a pulley diameter or the height of a pair of slides. Note that in FIG. 2 the height of the slides 78, 80 is much less than the height of the sash.

While the invention has been described in the context of a sash for holding the lower edge of the glass, it will be recognized that it applies to other glass support configurations. For example, in the absence of a sash, each pair of pulleys or slides could be mounted directly to the glass. In any event, the pulleys or slides are connected to the glass, either directly or through the intermediary of the sash. Also the invention has been described as having a cable fixed to the door at its upper ends and having a lower transverse run clamped in a manner to allow adjustment of the glass tilt. However, the cable configuration may be inverted so the cable ends are attached to the lower part of the door and the transverse run having the clamp are above the sash near the window opening.

The embodiments of the invention in which an exclusive property or privilege is claimed are defined as follows:

1. In a vehicle door having a glass movable between raised and lowered positions, and a regulator for moving the glass, the glass having a lower edge, a system for stabilizing the glass against rotational movement comprising:

first and second pairs of guides attached to the glass at the lower edge thereof and spaced transversely along the lower edge;

first and second upper anchor points on the door above the respective pairs of guides when the glass is in its raised position;

lower anchor means on the door below the lower edge of the glass when the glass is in the lowered position; and a taut cable extending from each of the upper anchor points and passing beneath a guide of the nearest pair, then passing transversely of the edge and above a guide of the furthest pair, and then down via a downward run to the lower anchor means; whereby any rotational moment tending to move one pair of guides up or down will be transmitted by the cable to move the other pair of guides in the same direction to prevent rotational movement.

2. The invention as defined in claim 1 wherein the guides comprise slides engaging the cable.

3. The invention as defined in claim 1 wherein the guides comprises pulleys engaging the cable.

4. The invention as defined in claim 1 wherein the system includes a sash secured to the lower edge of the glass and the guides are mounted on the sash.

5. The invention as defined in claim 1 wherein the lower anchor means comprises third and fourth anchor points transversely spaced such that the downward runs of the cable are parallel to the direction of glass movement.

6. The invention as defined in claim 1 wherein the lower anchor means comprises:

third and fourth anchor points transversely spaced such that the downward runs of the cable are parallel to the direction of glass movement and the cable extends between the third and fourth anchor points; and means for fastening the cable to prevent movement relative to the third and fourth anchor points.

7. The invention as defined in claim 6 wherein the means for fastening the cable includes an adjustment for establishing the attitude of the glass.

8. A cable system for stabilizing a glass in a vehicle door against rotational movement and allowing movement in a given direction between raised and lower positions, comprising:

an elongated sash secured to the glass for supporting the glass and extending along a lower edge of the glass;

a first guide at a first end of the sash, a second guide at a second end of the sash, a third guide at the first end of the sash, and a fourth guide at the second end of the sash;

a first anchor point on the door above the first guide and a second anchor point on the door above the fourth guide;

a third anchor point of the door below the second end of the sash and a fourth anchor point on the door below the first end of the sash; and a cable having two ends, one end secured to the first anchor point and the other end secured to the second anchor point, the cable being routed from the first anchor point down to and beneath the first guide, along the sash and above the second guide, down to the third anchor point, across to the fourth anchor point, up to and above the third guide, along the sash and below the fourth guide and finally up to the second anchor point, each up and down run of cable being parallel to the direction of glass movement;

whereby the cable assures that each end of the sash moves the same amount and in the same direction as the other end to prevent rotation of the glass.

9. The invention as defined in claim 8 wherein upon assembly the cable is slidable relative to the third and fourth anchor points to adjust the tilt of the sash relative to the third and fourth anchor points; and means for securing the cable against sliding relative to the anchor points to thereby maintain a fixed tilt of the sash.

* * * * *